US006441332B1

(12) United States Patent
Crawford et al.

(10) Patent No.: US 6,441,332 B1
(45) Date of Patent: Aug. 27, 2002

(54) SWITCH ASSEMBLY INCORPORATING CONTACT WEDGE

(75) Inventors: James F. Crawford, Newton, IA (US); Jeffrey L. Sears, Grinnell, IA (US); Harold T. Wilson, Colfax, IA (US)

(73) Assignee: Maytag Corporation, Newton, IA (US)

( * ) Notice: Subject to any disclaimer, the term of this patent is extended or adjusted under 35 U.S.C. 154(b) by 60 days.

(21) Appl. No.: 09/783,004

(22) Filed: Feb. 15, 2001

(51) Int. Cl.[7] ..... H01H 13/14

(52) U.S. Cl. ..... 200/520; 200/341; 200/533; 200/573

(58) Field of Search ..... 200/520, 533, 200/534, 535, 341, 573

(56) References Cited

U.S. PATENT DOCUMENTS

| | | | | |
|---|---|---|---|---|
| 1,911,444 A | | 5/1933 | Fator | |
| 3,715,545 A | * | 2/1973 | Long | 200/159 A |
| 3,736,395 A | | 5/1973 | Miller | |
| 3,902,032 A | | 8/1975 | Koepke | |
| 4,197,437 A | | 4/1980 | Michalski | |
| 4,361,743 A | | 11/1982 | Ayers | |
| 4,484,042 A | | 11/1984 | Matsui | |
| 4,609,795 A | * | 9/1986 | Lavigne et al. | 600/61.19 |
| 4,789,764 A | | 12/1988 | Doros | |
| 4,803,316 A | | 2/1989 | Hayashi et al. | |
| 4,913,285 A | | 4/1990 | Tsutsumi et al. | |
| 4,997,999 A | * | 3/1991 | Valenzona | 200/510 |
| 5,006,680 A | | 4/1991 | Thomas | |
| 5,055,642 A | | 10/1991 | Miyata | |

* cited by examiner

*Primary Examiner*—Anh Mai
*Assistant Examiner*—Kyung S. Lee

(57) ABSTRACT

A switch assembly includes both a separating wedge member, which functions to maintain two electrical contacts out of electrical communication, and a second, camming element, which can be used to squeeze the contacts together when the switch assembly is actuated. In a first embodiment, the second element is of a generally conical shape. In a second embodiment, the second element is actually constituted by two side members having ramped surfaces. The interaction of the specially shaped contacts and camming element ensures proper mating of the contact members when the switch is actuated. In one preferred form of the invention, an undulating channel is formed in a housing of the switch to pinch connecting wires and assure a positive, reliable connection with the contacts.

20 Claims, 3 Drawing Sheets

SWITCH ASSEMBLY INCORPORATING CONTACT WEDGE

BACKGROUND OF THE INVENTION

1. Field of the Invention

The present invention pertains to the art of electrical switches and, more particularly, to a switch assembly which utilizes a push button formed integral with a wedge member and at least one camming element for controlling the engagement state of a pair of electrical leads. When the push button is depressed, the wedge is moved from between electrical contacts, while the camming element pushes the contacts together.

2. Discussion of the Prior Art

It is well known in the art to provide a push button actuator for an electric or electronic switch. More specifically, it is known to utilize a plunger or push button within a housing to bias a spring member which, when pressure is applied to the push button, brings various contacts into electrical communication. Many of the recent designs represent attempts to eliminate either the number of moving parts, the number of total parts, the assembly time or assembly costs.

In a known device, a push button actuator is used to unite two electrical contacts to complete a circuit therebetween. Specifically, it is known in the art to provide a switch wherein a separating element is located between two electrical contacts. Because the contacts are biased toward each other, when the separating element is removed, the two contacts come into electrical communication and complete the circuit. U.S. Pat. No. 3,902,032 to Koepke describes an electrical switch wherein a separator element is integral with a cylindrical plunger, such that when the plunger is lowered, the separator element is removed from between a pair of electrical contacts. A spring is included which biases the plunger upwards. The biasing action of the spring causes the separator element to fit between angled sections of the electrical contacts in a default position. However, in order for this system to work, the contacts must maintain both their deformability and their internal biasing toward each other. If the contacts were to lose either of these necessary characteristics, when the separator element is removed from between the contacts, the contacts would not naturally rejoin.

In another system, the contacts are simply pushed together by an actuator. U.S. Pat. No. 1,911,444 to Fator describes a switch contained within a gripping device. In this design, two electrical contact members are biased away from each other such that, in the default position, the contacts are not in electrical communication. The entire apparatus is generally contained within a cylindrical housing, with the switch disposed in the center thereof. When the sides of the cylindrical housing are squeezed together, two plunger buttons are forced inward and push the contacts together. Although in such a system the contacts are pushed together rather than apart, the same limitations remain as discussed above.

Each of the systems described above, as well as most others in the art, do not address a second problem. It is common to have the electrical contacts extend through the housing of the switch assembly to allow for connection to the remainder of the electrical circuit. This is normally accomplished by extending the contacts below the switch assembly and attaching a respective lead wire to each. However, when attached in this fashion, the wires are often simply hanging off of the contacts. This serves as a stress location and, as such, a potential failure point for the overall switch assembly.

Switch assemblies, generally constructed in the manner set forth above, can be used in various environments. One particular environment of concern is in appliances, particularly clothes washing and drying machines. In such appliances, it is common to provide a control panel having various buttons which are associated with switches for enabling a consumer to select various operating parameters of the machine for a particular cycle. For instance, in the case of washing machines, it is common to provide a row of buttons which would enable the consumer to select a desired water temperature for both washing and rinsing cycles. It would not be uncommon to provide a bank of buttons in a single housing, with the buttons being associated with switches and further being interconnected such that the depression of one button would automatically cause the release of another button. For example, if the bank of buttons or switches control the selection between hot/hot, warm/warm, warm/cold and cold/cold wash and rinse temperatures respectively, the depression of the button associated with the warm/warm setting would automatically cause any other depressed button in the bank to be released. In general, cams and levers are utilized to interconnect the various push buttons to operate in this manner. In any event, since the useful life of such an appliance can be quite long, the switches must be extremely reliable. However, the overall construction of the switch assembly directly affects its associated cost, reflected in both the components themselves and the time needed for assembly and installation. In general, it is considered that the installation of conventional multi-switch devices are often difficult or time consuming. Primarily, the time and expense comes from being forced to install individual wires to at least two different locations of each switch in a known multi-switch device. In any event, there exists a need in the art for a push button switch assembly which overcomes the drawbacks of the prior art and which represents an overall switch which is easy to assemble, is cost effective and requires a minimum number of components, while being extremely reliable over a prolonged period of time.

SUMMARY OF THE INVENTION

The present invention is particularly directed to a switch assembly including a housing and two electrical contacts which are maintained separated from each other by a wedge. The wedge is formed integral with a push button such that, when the push button is depressed, the wedge is forced out of engagement with the contacts. This allows the contacts to come into electrical communication. A camming element, which is integral with the push button, pushes the contacts together when the push button is depressed.

The switch assembly includes a housing designed to hold the various parts of the switch assembly in place. Primarily, the contacts are attached to wires which extend outside the housing. Between the outside of the housing and where the wires are mounted to the contacts, the wires are placed in a wavy channel formed in the housing. When the housing is completely assembled, the wires are pinched and held in place between upper and lower sections of the housing which form the channel.

In a first embodiment, the push button includes a conically shaped member, which defines the camming element, with an open wide face. The contacts are positioned inside the conically shaped member such that contact elements extend into a narrowing end of the conically shaped member. The wedge extends between the contacts such that, when in place, the wedge prevents the contacts from mating. When the push button is depressed, the wedge is forced from between the contacts and allows the contacts to mate. In addition, the conically shaped member presses against the contacts and forces the contacts together. A spring is included to maintain the push button and contacts in their default positions.

In a second embodiment, instead of having a conically shaped member, two side members are provided with respective camming surfaces which essentially perform the same function as the conically shaped member of the first embodiment. In the default position, a wedge extends between the contacts and prevents their mating. When the push button is depressed, the wedge is removed and the contacts are engaged by the side members. Each side member unites with a bent section of each of the contacts and actually pushes them together. Two springs are included to maintain the push button and contacts in default positions.

Additional objects, features and advantages of the invention will become more readily apparent from the following detailed description of preferred embodiments thereof, when taken in conjunction with the drawings wherein like reference numerals refer to corresponding parts in the several views.

DETAILED DESCRIPTION OF THE PREFERRED EMBODIMENTS

Figure 1:
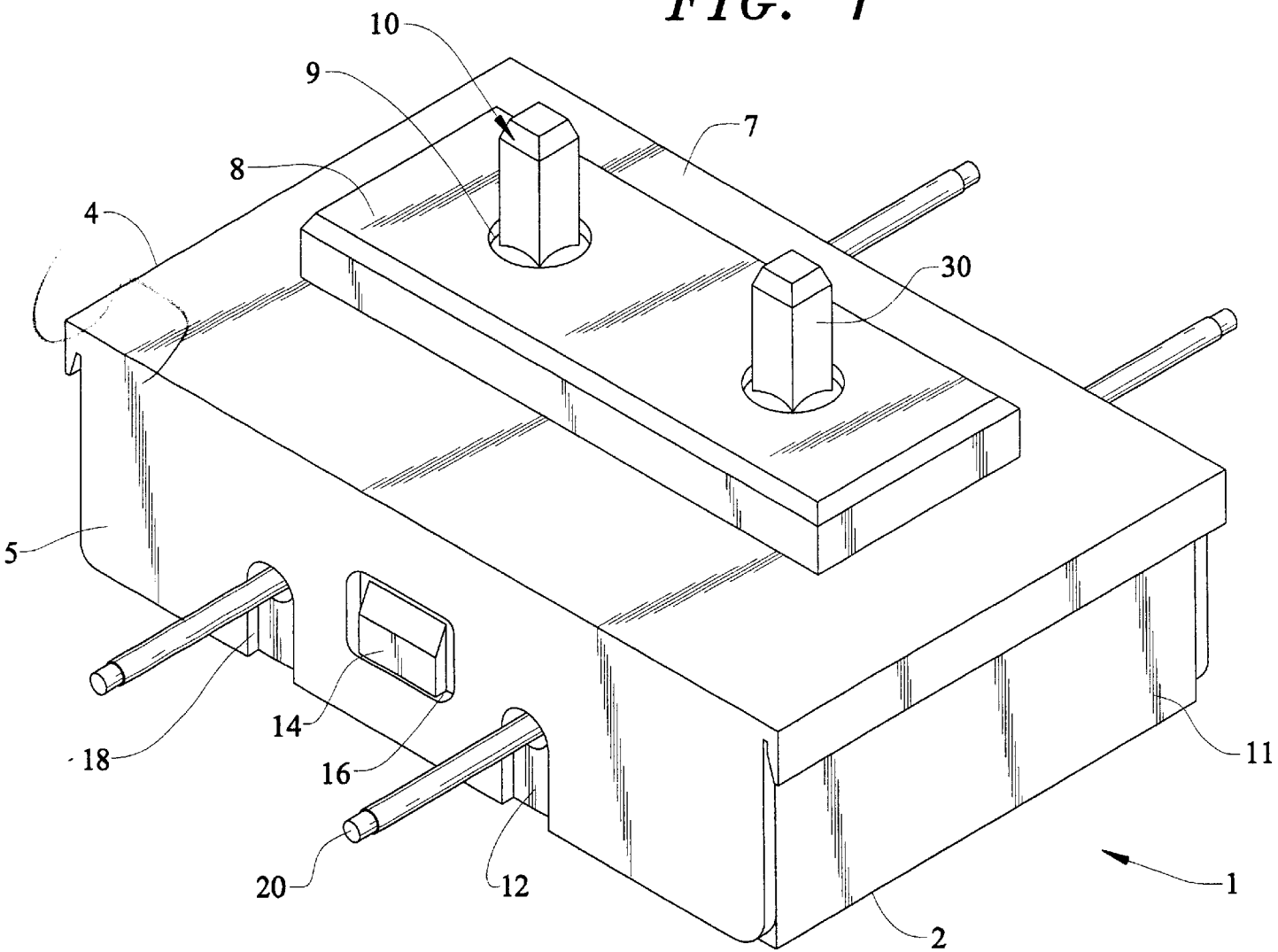
FIG. 1 is a perspective view of a switch assembly constructed in accordance with a first embodiment of the invention, with the switch assembly being shown in a completely assembled state.

A switch assembly 1 of the first embodiment of the invention is depicted in FIG. 1 and generally includes a housing 2, with a cover 4. Cover 4 is preferably defined by two spaced sides 5 and an integrally formed top 7. As shown, top 7 includes a rectangular raised section 8 in the same shape as top 7 itself, but smaller in both length and width. Raised section 8 is provided with two push button apertures 9 through which push buttons 10 respectively protrude.

The shape of housing 2 generally complements the general shape of cover 4. More specifically, the housing 2 includes two upstanding spaced apart short sides 11, two spaced apart long sides 12 and a bottom 13 (more clearly shown in FIGS. 2 and 3) which define an open rectangular box. On each of sides 12, housing 2 includes a cover mounting tab 14. Each mounting tab 14 is essentially constituted by a ramped protrusion which, when mated with a corresponding cover mounting aperture 16, helps to secure cover 4 in a snap-fitting manner onto housing 2. Because of the ramped shape of cover mounting tabs 14, apertures 16 slide easily across the face of the cover mounting tabs 14. Apertures 16 are generally the same shape as tabs 14, but are larger in each dimension to permit installation and removal of the cover 4. In addition, apertures 16, as well as tabs 14, are situated on both cover sides 5 and both sides 12 of housing 2, respectively.

Cover 4 also includes rounded slots 18 designed to extend around wires 20 which may project through one side 12 during installation of cover 4. FIG. 1 shows two slots 18 and corresponding wires 20 extending through the side 12. FIG. 1 also shows housing 2 with two identical parallel switch bays. However, the invention could include only a single switch bay in housing 2 or, alternatively, may include multiple switch bays. As each switch bay is identical, the description of one switch bay is sufficient to fully explain each of the included switch bays.

Figure 2:
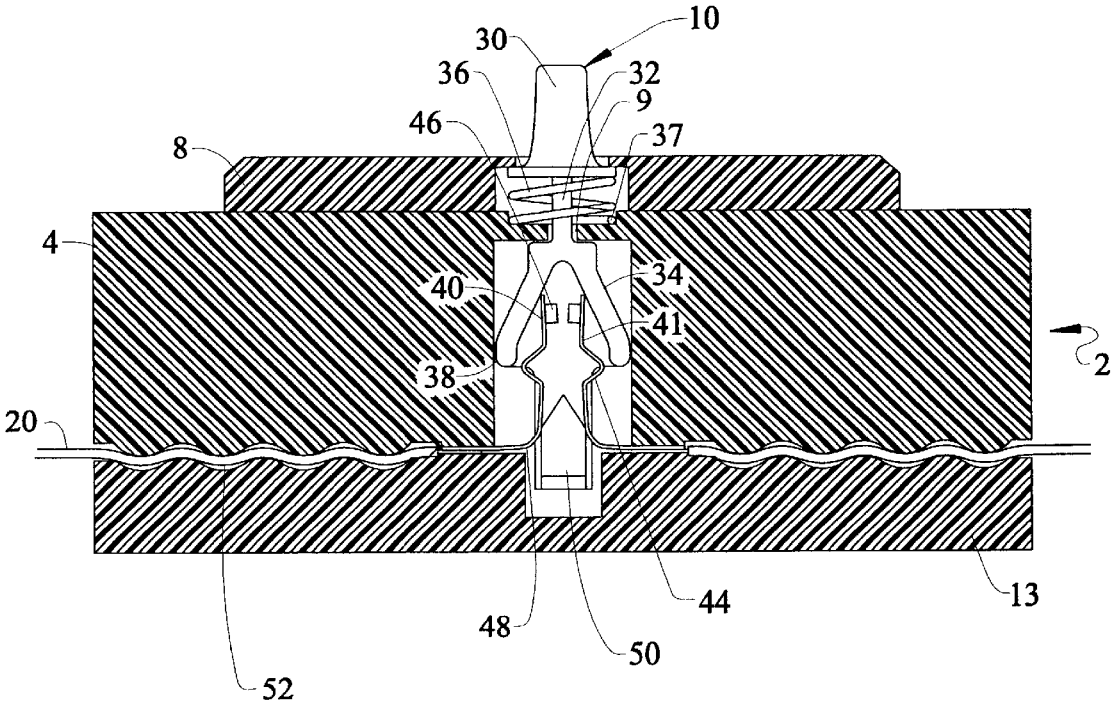
FIG. 2 is a cross-sectional side elevational view of the switch assembly of FIG. 1 shown in the default or non-engaged position.
Figure 3:
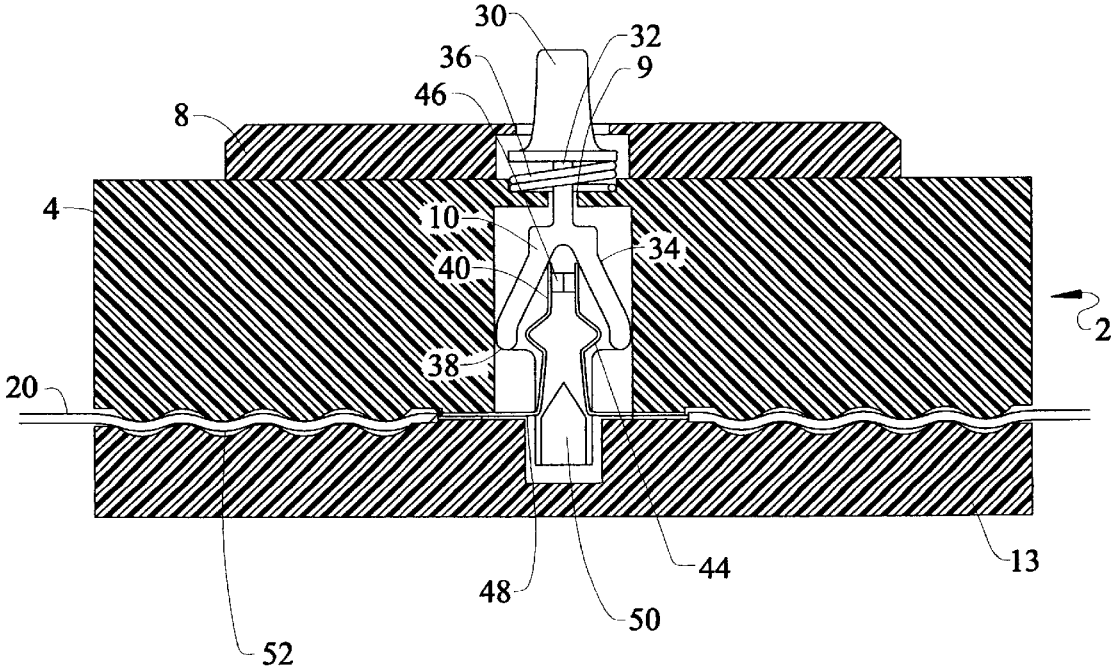
FIG. 3 is a cross-sectional side elevation view of the switch assembly of FIG. 1 shown in an engaged position.

FIGS. 2 and 3 depict the moving parts of switch assembly 1 in accordance with the first embodiment of the invention. As shown, push button 10 includes an upper projection 30, a neck 32 and a lower projection 34. FIG. 1 shows upper projection 30 extending through aperture 9 of cover 4. Lower projection 34 is contained completely within housing 2. The neck 32 joins upper projection 30 and lower projection 34. Annularly disposed about neck 32 is a compression spring 36 which maintains push button 10 in a default position as shown in FIG. 2. Here, spring 36 extends between upper projection 30 and recessed portion 37 of housing 2, and because of its shape, biases upper projection 30 away from housing 2. Therefore, depressing push button 10 compresses spring 36 as both upper and lower projections 30 and 34 shift.

In this embodiment, lower projection 34 is shown defined by a hollow, conically shaped member. Specifically, lower projection 34, includes a wide bottom 38 which is open to allow two elongated contacts 40 and 41 to be inserted therein. Contacts 40 and 41 are preferably constructed of conductive metal, but may be formed from any electrically conductive material. Contacts 40 and 41 are biased apart, both internally and due to interactions with the remaining elements of switch assembly 1 as will be detailed further below. In addition, contacts 40, 41 includes a bent section 44 approximately half-way along its length. Bent section 44 is arranged such that, in the default position of the switch assembly 1, it is not engaged by lower projection 34. Disposed on each of contacts 40 and 41 is a respective contact element 46, with contact element 46 being opposed to each other and adapted to unite when switch assembly 1 is actuated as shown in FIG. 3. Contact elements 46 are also constructed of an electrically conductive material and are placed to aid in mating of contacts 40 and 41.

Moving down the length of each contact 40, 41 away from contact element 46, an angled section 48 is reached. Most preferably, each contact 40, 41 is generally L-shaped in side-view. Where each contact 40, 41 forms angled section 48, contacts 40 and 41 are adapted to be engaged by a wedge 50. Wedge 50 is integrally formed as part of push button 10 and is positioned with a narrow end between the two contacts 40, 41. With push button 10 in its default position (FIG. 2), wedge 50 engages the contacts 40 and 41 to maintain their separation.

Connected to one end of each contact 40, 41, remote from a respective contact element 46, is a wire 20 which extends into housing 2. At the location where each contact 40, 41 joins a wire 20, cover 4 and bottom 13 of housing 2 define a channel 52 into which wire 20 is placed. By forming channel 52 into a wavy or undulating configuration, wire 20 is pinched between cover 4 and bottom 13. This gives greater flexibility in the placement of wire 20 outside the switch assembly 1 because there is little chance of each wire 20 losing its electrical communication with its respective contact 40, 41.

As indicated above, the position shown in FIG. 2 is the default or non-engaged position for switch assembly 1. Here, contacts 40 and 41 are spaced apart. Wedge 50 is shown positioned between contacts 40 and 41 and accordingly prevents mating of contacts 40 and 41 by pushing them apart. Because of spring 32, push button 10 is biased to cause lower projection 34 to move away from contacts 40 and 41. As a result, contact elements 46 are spaced apart and no electrical current is permitted to flow therebetween. As such, when push button 10 is in the position shown in FIG. 2, no electrical circuit is completed.

In contrast, FIG. 3 depicts switch assembly 1 in an engaged configuration. First, upper projection 30 of push button 10 is depressed against the biasing of spring 32. This causes lower projection 34 of push button 10 to interengage contacts 40 and 41. Because lower projection 34 is conically shaped, inner surfaces are ramped and define at least one camming surface. As contacts 40 and 41 slide along the inner surface of lower projection 34 towards the narrow end of the conically shaped member, contacts 40 and 41 are moved closer together. Because wedge 50 is integral with push button 10, at the same time lower projection 34 moves into engagement with contacts 40 and 41, wedge 50 is moved out of engagement with contacts 40 and 41. Due to the internal biasing of contacts 40 and 41 and pressures exerted by lower projection 34, contact members 40 and 41 abut one another.

Figure 5:
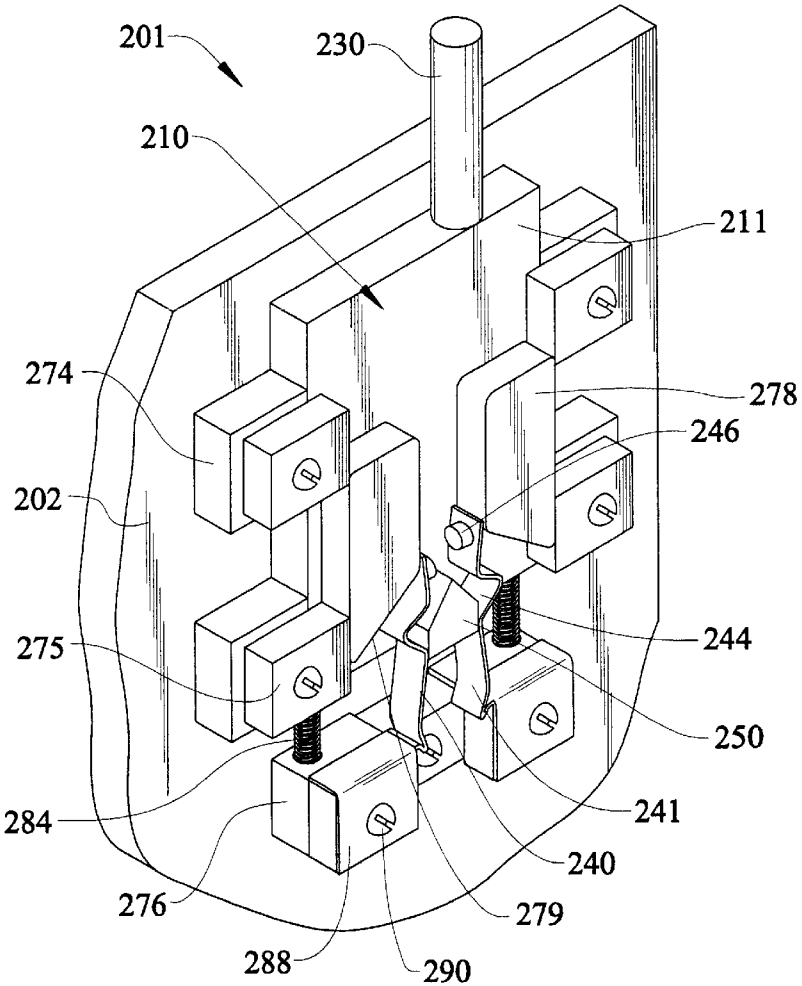
FIG. 5 is a perspective view of the switch assembly of FIG. 4, with the switch assembly being shown in a default or non-engaged position.
Figure 4:
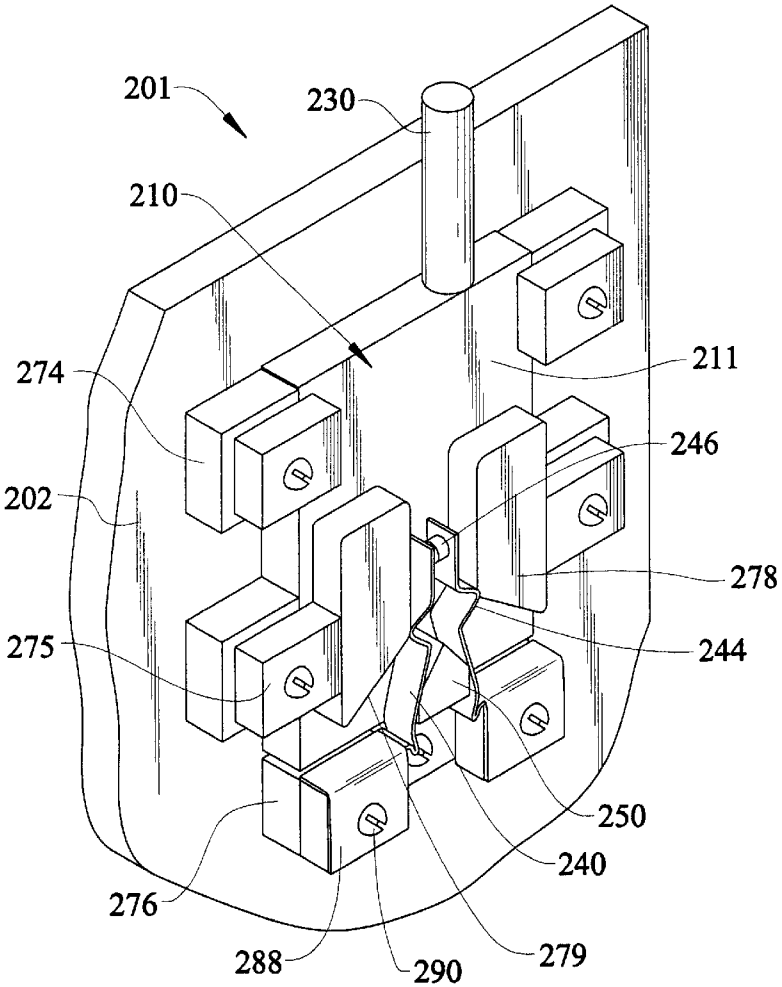
FIG. 4 is a perspective view of a switch assembly constructed in accordance with a second embodiment of the invention, with the switch assembly being shown in an engaged position.

FIGS. 4 and 5 depict a switch assembly 201 in accordance with a second embodiment of the invention. As shown, switch assembly 201 includes a push button 210 having a base 211, and an upper projection 230 which can be used to manually or electrically shift push button 210. Push button 210 is adapted to various base guides 274 and respective overlapping of block guides 275. In addition, a pair of blocks 276 limit the extent to which push button 210 may slide. Projecting out from base 211 of push button 210 are two side wedge members 278, with ramped or camming surfaces 279. Positioned between side members 278 are two contacts 240 and 241. Contacts 240 and 241 are preferably constructed of a conductive metal, but may formed from any electrically conductive material. Contacts 240 and 241 are biased apart, both internally, and due to interactions with push button 210. In addition, each contact 240 and 241 includes a bent section 244 along its length. Bent section 244 is placed such that, in a default position of switch assembly 201, it is not engaged by a respective side member 278. Disposed on each contact 240, 241 is a contact element 246, positioned where the two contacts 240 and 241 unite when switch assembly 201 is actuated. Contact elements 246 are also constructed of an electrically conductive material and are placed to aid in the mating of contacts 240 and 241. Additionally, each contact 240, 241 includes a section 288 which is affixed over one of the blocks 276.

A wedge 250, integrally formed with base 211 of push button 210 includes a narrow end which projects between contacts 240 and 241. With push button 210 in its default position, wedge 250 extends well between contacts 240 and 241 and forces them apart (FIG. 5). Extending between each block 276 and push button 210 is a spring 284 which biases push button 210 to a position which forces wedge 250 between contacts 240 and 241. Springs 284 are obscured from view in FIG. 4 as they are compressed between base 211 of push button 210 and blocks 276.

As represented in FIG. 4, when push button 210 is depressed, it moves toward blocks 276 and compresses springs 284. Because side members 278 are integral with push button 210, movement of push button 210 causes side members 278 to shift such that ramped surfaces 279 engage bent sections 244 of contacts 240 and 241 thereby forcing contacts 240 and 241 together. In addition, because wedge 250 is integral with base 211 of push button 210, wedge 250 also moves when push button 210 is depressed. Therefore wedge 250 is shiftable from its default position, between contacts 240 and 241 at bent sections 244 (FIG. 5), to below bent sections 244 whereat contact elements 246 become engaged (FIG. 4). Wires (not shown) are attached to contacts 240 and 241, preferably via screws 290 in order to enable activation of switch assembly 201.

Although described with reference to preferred embodiments, it should be readily understood that various changes and/or modifications can be made to the invention without departing from the spirit thereof. For example, although the switch assemblies 1 and 201 of the invention have been described as being momentary switches where the switch returns to the default position when the pressure being applied is removed, it would be easy for one of ordinary skill to use the switch assemblies of the invention as on-off type switches. In any event, the invention is only intended to be limited by the scope of the following claims.

We claim:

1. A switch assembly comprising:

a housing;

first and second electrical contacts extending within said housing and including first and second contact zones respectively; and a push button including a wedge member and at least one camming surface, said push button being shiftable between a first position, wherein the wedge member projects between the first and second contacts to maintain a space between the first and second contact zones, and a second position, wherein the first and second contacts are forced into engagement at the first and second contact zones by the at least one camming surface abutting each of the first and second contacts.

2. The switch assembly according to claim 1, wherein said wedge member and said at least one camming surface move in unison.

3. The switch assembly according to claim 2, wherein said wedge member includes an angled tip extending between and directly engaging said first and second contacts.

4. The switch assembly according to claim 3, wherein said angled tip is vertically spaced from said camming surface.

5. The switch assembly according to claim 1, wherein said first and second contacts maintain a normally open position.

6. The switch assembly according to claim 1, wherein said push button includes a manually engageable upper projection extending from the housing.

7. The switch assembly according to claim 1, wherein each of said first and second contacts is L-shaped with first and second legs.

8. The switch assembly according to claim 7, wherein said housing includes first and second mating portions.

9. The switch assembly according to claim 8, wherein said first and second mating portions of the housing sandwich the first leg of each said contact.

10. The switch assembly according to claim 9, wherein said first and second mating portions define a wire guide channel.

11. The switch assembly according to claim 10, wherein said wire guide channel undulates within said housing.

12. The switch assembly according to claim 1, further comprising: at least one spring positioned to bias said push button to said first position.

13. A switch assembly comprising:

first and second electrical contacts including respective first and second contact zones;

a push button including at least one camming surface, said push button being shiftable between a first position, wherein a space is maintained between said first and second contact zones, and a second position, wherein the first and second contacts are forced into engagement at the first and second contact zones by the at least one camming surface; and a housing within which the push button and the first and second contacts extend, said housing including first and second portions which mate to define at least one undulating, wire guide channel therebetween.

14. The switch assembly according to claim 13, wherein said camming surface is defined by two side members, each including a ramped surface.

15. The switch assembly according to claim 13, wherein each of said first and second contacts includes a bent section wherein, when said push button is in said second position, said camming surface engages said contacts at said bent sections.

16. The switch assembly according to claim 13, wherein sections of the first and second contacts are sandwiched between portions of the housing.

17. The switch assembly according to claim 13, further comprising: at least one spring positioned to bias said push button to said first position.

18. The switch assembly according to claim 13, wherein said push button includes a wedge member, wherein the wedge member projects between the first and second contacts to maintain a space between the first and second contact zones when the push button is in the first position.

19. The switch assembly according to claim 18, wherein said wedge member and said at least one camming surface move in unison.

20. The switch assembly according to claim 19, wherein said wedge member includes an angled tip extending between said first and second contacts when the push button is in said first position.

* * * * *